United States Patent [19]

Couwenberg et al.

[11] Patent Number: 4,716,440

[45] Date of Patent: Dec. 29, 1987

[54] POSITIONING DEVICE FOR SHEET ON EXPOSURE PLATEN OF A COPYING MACHINE

[75] Inventors: Franciscus A. C. M. Couwenberg, Veldhoven; Cornelis J. Groenenberg; Antonius C. S. Wetjens, both of Venlo, all of Netherlands

[73] Assignee: Oce-Nederland B.V., Venlo, Netherlands

[21] Appl. No.: 927,645

[22] Filed: Nov. 5, 1986

[30] Foreign Application Priority Data

Nov. 6, 1985 [NL] Netherlands ..... 8503038

[51] Int. Cl.[4] ..... G03G 15/00

[52] U.S. Cl. ..... 355/14 SH; 355/75; 271/246; 271/236

[58] Field of Search ..... 355/14 SH, 75, 3 SH; 271/236, 239, 245, 246, 234

[56] References Cited

U.S. PATENT DOCUMENTS

| | | | |
|---|---|---|---|
| 3,984,098 | 10/1976 | Stange et al. | 271/236 |
| 4,592,543 | 6/1986 | Tanimoto et al. | 355/75 |
| 4,645,331 | 2/1987 | Berger | 355/75 |

*Primary Examiner*—Peter S. Wong
*Assistant Examiner*—Judson H. Jones
*Attorney, Agent, or Firm*—Reed Smith Shaw & McClay

[57] ABSTRACT

A device for positioning an original in sheet form on the exposure platen of a copying machine, comprising abutment strips which extend parallel to each other at opposite sides of the platen and which are displaceable to and from each other for adjusting them to the width of an original fed between the strips on to the exposure platen. In front of each strip and displaceable therewith is at least one pair of rollers disposed with their axis parallel to the strips. A first roller of each pair being closer to the exposure platen and the associated strip than the other roller of that pair. A flexible belt for pressing an original on to the platen is trained between the platen and the said first rollers of each pair and about said first rollers and in opposite direction over said other rollers and then over the strips towards the frame of the device.

For positioning an original fed on to the platen flat against the platen, the first rollers are moveable in a direction perpendicular to the platen in order to press the flexible belt against the original to close to the abutment strips, irrespective of the width of the original.

6 Claims, 3 Drawing Figures

POSITIONING DEVICE FOR SHEET ON EXPOSURE PLATEN OF A COPYING MACHINE

FIELD OF THE INVENTION

The present invention relates to a device for positioning sheet material on the exposure platen of a copying machine and, in particular, to a positioning device in which a pair of parallel adjustable abutment strips for abutting the sheet material there between and retaining the sheet by means of a flexible belt entrained about a pair of rollers moveably displaceable to and away from the platen.

BACKGROUND OF THE INVENTION

Devices for positioning or registering sheets with respect to a platen or orthogonally related surfaces are generally well known, especially in the art of making photocopying machines. See, e.g., U.S. Pat. No. 4,026,542 which discloses the use of air streams to move a sheet into registry within an abutment. Also, U.S. Pat. No. 4,469,319 discloses the use of a sheet stacking tray having a displaceable side guide abutment for accommodating sheet material of various widths in a recirculating document feeder.

In another device of this kind, U.S. Pat. No. 3,984,098 shows a device having a rectangular exposure platen and abutment strips which extend along three edges of the platen, but which are immovably connected thereto. A pressure plate is fitted between the strips for movement between a first position in which the plate is at some distance from the platen so that an original can be fed between the strips on the platen and pressed against two strips at right angles to one another, and a second position in which the plate presses the positioned original against the platen.

This device is suitable for positioning an original on the exposure platen at a fixed corner and holding it flat in that position so that the original can be copied without any loss of sharpness. However, in copying machines it is frequently necessary to position an original on the platen in one of a number of possible positions. For example, originals having different dimensions can be disposed in the copying machine with two opposite edges symmetrically with respect to the optical axis of the optical imaging system so that they can be imaged on a fixed location on the machine irrespective of the selected imaging ratio.

Accordingly, it is an object of the invention to provide a device by means of which an original can be selectively positioned on a number of locations on an exposure platen and can be pressed at those places.

SUMMARY OF THE INVENTION

Generally, the present invention comprises at least one, adjustable abutment means displaceably secured to a frame member. A first pair of first and second rollers are disposed with their axes parallel to and near the abutment means and are displaceable together with said abutment along the platen. The first roller is positioned to press the pressure member against the exposure platen. Preferably, the pressure member comprises a flexible belt which is secured by the ends to the frame and is entrained between the first roller and the platen and then about the roller and is then entrained in the opposite direction about the second roller and over the abutment to the frame. As a result, the original can be kept in contact with the platen to close to the abutment means in every selected position of the abutment means.

In another embodiment, a second abutment means is provided which is parallel to the first abutment means. The second abutment is also displaceably secured to the frame. Between the two abutments an original can be fed onto the platen. At the second abutment, a second pair of first and second rollers is disposed which is displaceable with the second abutment means along the platen. The first roller of said second pair is adapted to press the pressure member against the platen to secure the sheet. The flexible belt is trained about the first and second roller of the second pair in the same way as the first pair of rollers.

Consequently, in this embodiment the distance between the two abutments means can be adjusted to the width of the original for the alignment of an original therebetween and the original is always capable of being pressed flat on the platen to close to those abutments means.

In a particularly preferably embodiment, the abutment means consists of a thin strip of resilient material secured against a bar. One edge of each strip projects approximately 0.5 to 1 mm from the bar and presses against the platen in the operative position. The abutment bar with the projecting strip is secured to the frame so as to be movable in two directions perpendicular to one another in order to left the strip from the platen, displace the strip in the lifted position, and deposit the strip on another part of the platen.

Consequently, if the platen surface is somewhat corrugated, something that is practically always the case, the abutment bears against the platen over its entire length, with local deflection of the strip, so that thin originals cannot jam between the platen and the abutment.

Other advantages of the invention will become apparent from a perusal of the following description of presently preferred embodiments of the invention taken in connection with reference to the accompanying drawings.

PRESENTLY PREFERRED EMBODIMENTS

Figure 1:
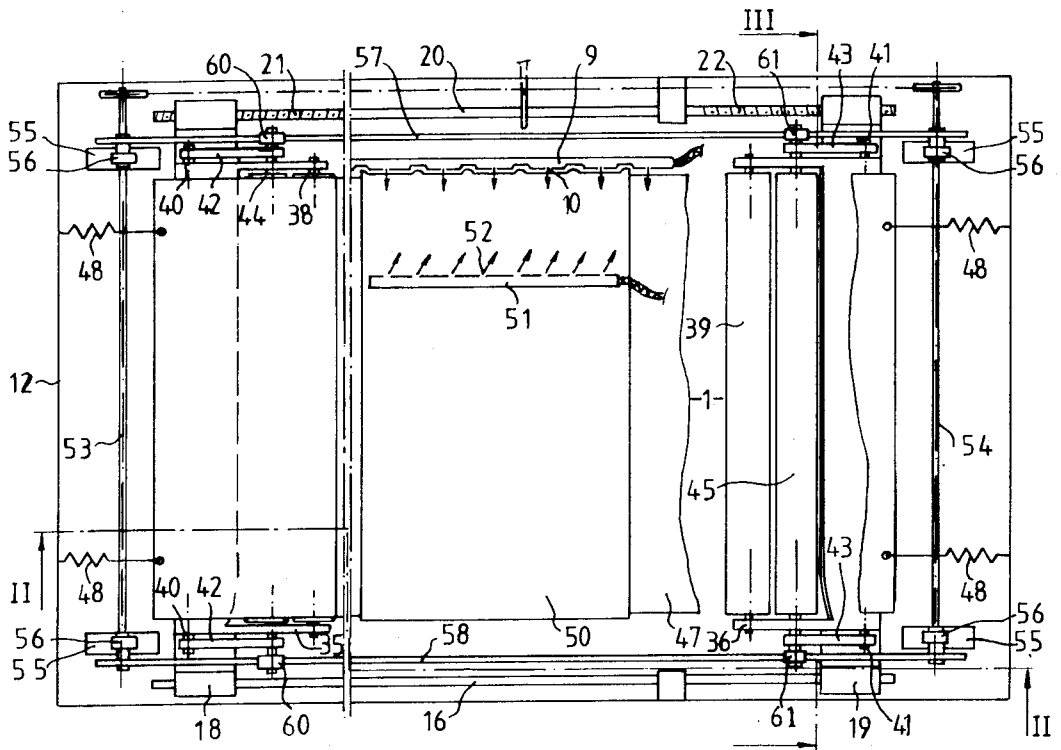
FIG. 1 is a plan view of a device according to the invention.
Figure 2:
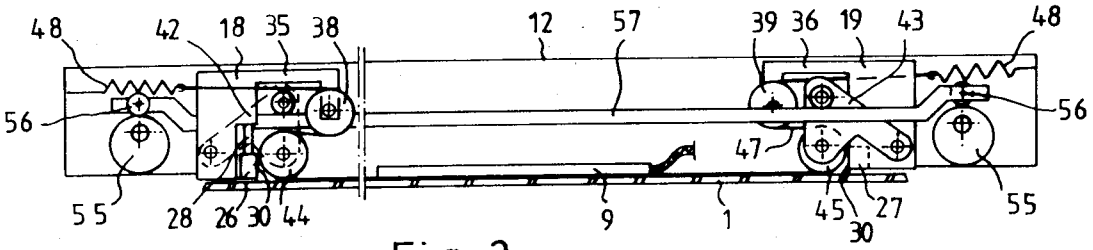
FIG. 2 is a sectional elevation along line II—II of FIG. 1.

Referring to the figures, platen 1 of a copying machine is shown on which an original document of sheet material to be copied can be placed. Adjacent to an edge zone 4 of exposure platen 1 is feed path 2 and discharge path 3, which include conveyor rollers 5, 6 and 7 rotatable in the direction of the arrows. Conveyor rollers 5 and 6 together form a conveying nip for conveying an original fed in path 2 until most of the sheet is on exposure platen 1. Conveyor rollers 6 and 7, on the other hand, form a conveying nip for discharging via path 3 and original which has partially been discharged from the exposure platen 1.

Figure 3:
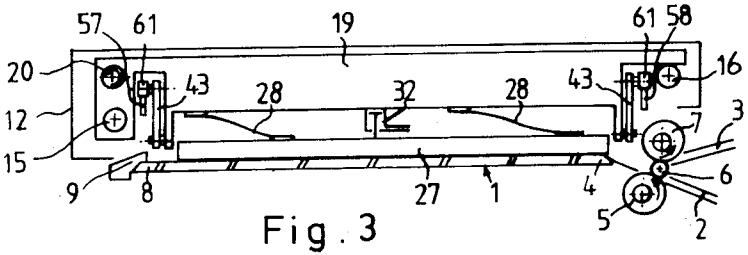
FIG. 3 is a sectional elevation along line III—III of FIG. 1.

Opposite to edge zone 4, hollow abutment strip 9 is secured to edge zone 8 of exposure platen 1. Abutment strip 9 is provided with a row of apertures 10 through which air can flow to partially discharge from the exposure platen 1 an original positioned thereon. A cover is placed on the exposure platen 1 which has frame 12 that is pivotally connected by means (not shown) to the fixed part of the copying machine so that the exposure platen can be cleared for manually positioning an original on the exposure platen 1, such as an opened book. Guide rods 15 and 16 (see in FIG. 3) are secured to frame 12 and extend parallel to strip 9 on either side in the cover.

Two bars 18 and 19 extend some distance from one another between the rods 15 and 16 and are each slideably connected to said rods at the ends.

A drivable spindle 20 is mounted in frame 12 and its ends 21 and 22, respectively, are screwthreaded with opposite pitches. A nut forming part of bar 18 fits on the screwthread of end 21 and a nut forming part of bar 19 fits on the screwthread of end 22. Spindle 20 can be rotated in both directions in order to move bars 18 and 19, respectively, to and away from one another over equal distances.

Rulers 26 and 27, respectively, are secured by leaf springs 28 (seen in FIG. 3) at the facing sides of the bars 18 and 19, respectively. Leaf springs 28 are connected by one end to the associated bar and by the other end to the associated ruler. Leaf springs 28 allow a ruler to move only with respect to the associated bar in a direction perpendicular to exposure platen 1. The facing sides of rulers 26 and 27 are covered with a thin strip of resilient material, e.g., an 0.2 mm thick foil of Kapton, which projects a short distance, e.g., 015 mm, beneath the associated bar. In the operative position of the cover leaf springs 28 press the projecting edges of the strips 30 against the exposure platen, so that as a result of the resiliency of the strip material the strips bear against the exposure platen over the entire length, even if the exposure platen is slightly corrugated.

The strips 30 thus form a guide, or an abutment means respectively, for an original fed onto exposure platen 1. It is thereby impossible for the original to come between the abutment means and exposure platen. Ruler 26, or 27, respectively, with the strip 30 can be lifted from exposure platen 1 against the action of the leaf springs 28 by means of pneumatic cyclinder 32 (indicated diagrammatically in FIG. 3).

Near its ends, bar 18 is provided with facing projections 35 and bar 19 is provided with facing projections 36 near its ends. A rotatable roller 38 is secured between projections 35 and a rotatable roller 39 is located between the projections 36.

Near each end bars 18 and 19 are also provided with a pin 40 or 41, respectively, on which an arm 42, or 43, respectively, is rotatably secured. A rotatable first roller 44 of a first pair of rollers is secured between the ends of arms 42 and first rotatable roller 45 of a second pair of rollers is positioned between the ends of the arms 43. Roller 44 is positioned closer to exposure platen 1 and to ruler 26 than its associated second roller 38. Roller 45 is positioned closer to exposure platen 1 and ruler 27 than its associated second roller 39.

A flexible belt 47, preferably a 0.05 mm thick steel belt, extends above exposure platen 1. Adjacent its ends, belt 47 is trained up about first rollers 44 and 45 of the first and second pair and then trained in the opposite direction about second rollers 38 and 39 and thereafter over bars 18 and 19, respectively. The ends of belt 47 are fixed to frame 12 of the cover by means of springs 48. A plate 50 is secured above a section of the flat part of belt 47 which extends between first rollers 44 and 45. A pipe 51 connected to a flexible air supply is secured to plate 50 at some distance from and parallel to abutment strip 9. In the bottom of pipe 51, as well as in plate 50 and belt 47 therebeneath, continuous outflow apertures 52 are located at regular intervals preferably with a section of 0.7 mm and at an angle of about 45° to abutment strip 9 and ruler 27, and at an angle of about 20° to exposure platen 1.

A spindle, 53 or 54, respectively, is mounted rotatably at each of the sides of bars 18 and 19 which are remote from one another. Cylindrical discs 55 are eccentrically secured to the ends of these spindles.

Rollers 56 rest on discs 55 and are secured in pairs to the ends of two straight members 57 and 58 extending on two opposite sides of the cover 12. Two rollers 60 and 61 rest on the horizontal top edge of each of these members and are each rotatably secured to an arm, 42 and 43, respectively.

The operation of the device is as follows:

In the starting position, discs 55 are in the top position, so that members 57 and 58 also occupy the top position. First rollers 44 and 45 and that section of belt 47 which extends therebetween, are also held at some distance from the exposure platen 1 via rollers 60 and 61 resting on the members, and the arms 42 and 43. Prior to the copying of originals in sheet form, which have to be fed via path 2, the device is adjusted to the dimensions of an original that is to be fed. For the adjustment, the copying machine control system delivers a signal in response to which pneumatic cylinders 32 are actuated so that rulers 26 and 27 are lifted from exposure platen 1. The distance between bars 18 and 19 can be adjusted, by rotation of spindle 20, to the dimensions of the original to be fed. Bars 18 and 19, and, hence, rulers 26 and 27 secured thereto, move symmetrically with respect to a central line. This is important for imaging originals of different sizes on a fixed place in the machine, as described above. After the adjustment and before the start of the copying process, the control system delivers a signal, in response to which pneumatic cylinders 32 are de-energized and leaf springs 28 press rulers 26 and 27 with their flexible strips 30 against exposure platen 1. The device is now ready to receive an original.

Since the rulers can be moved only in the lifted position, strips 30 which form the abutments are always pressed onto the exposure platen perpendicularly and the abutment strips are prevented from sliding over the exposure platen. Otherwise such strips could be deflected each time in a different position, depending upon the direction of the adjustment, causing the positioning accuracy of an original on the exposure platen to be adversely affected.

OPERATION

At the start of a copying cycle, an original is fed onto platen 1 from feed path 2 by the pair of conveyor rollers 5 and 6 between the strips 30. At the same time, air is injected from apertures 52 in pipe 51 into the space between belt 47 and exposure platen 1. This air, which flows onto the original in the direction of abutment strip 9 and ruler 27 presses the original, after it has completely passed the nip between conveyor rollers 5 and 6 against abutment strip 9 and strip 30 of ruler 27. After a fixed time has elapsed during which the original is positioned, spindles 53 and 54 are rotated half a revolution so that discs 55 drop. Members 57 and 58 resting by rollers 56 on the discs can now move down by their own weight. First belt guide rollers 44 and 45 secured to arms 42 and 43, and the section of the belt 47 situated therebetween, can also move down by their own weight onto the now positioned original. The slight displacement of belt 47 in the longitudinal direction as a result of rotation of belt guide rollers 44 and 45 is absorbed by springs 48 which stretch the belt taut.

After the original, which is positioned and held flat in this way, has been exposed to light the required number of times, spindles 53 and 54 rotate to the starting position, so that the belt 47 is again released from the original. At the end of the copying cycle air is injected via apertures 10 in abutment strip 9 into the space between belt 47 and exposure platen 1, so that the original is blown off the exposure platen. The leading edge of the original is now engaged in the nip between conveyor rollers 6 and 7 which discharge the original via path 3. The device is now back in the starting position for performing a copying cycle with a next original.

While presently preferred embodiments of the invention have been shown and described in particularity, it may be otherwise embodied within the scope of the appended claims.

What is claimed is:

1. A device for positioning an original in sheet form on the exposure platen of a copying machine, comprising:

a. a frame having at least one abutment means adaptable for movement into an operative position in contact with said exposure platen;

b. means for feeding said original sheet onto said platen and against the abutment means;

c. a first pair of first and second rollers disposed with their axes parallel and adjacent to said abutment means, said rollers being displaceable with said abutment means along said platen;

d. means for displacing said first roller towards the platen; and e. a pressure member consisting of a flexible belt having opposite ends which are secured to said frame and being entrained between said first roller and said platen and about said first roller and in the opposite direction being entrained about said second roller and over the abutment towards the frame whereby displacement of first roller towards the platen presses said pressure member against said sheet.

2. A device according to claim 1, including a second abutment means parallel to said first abutment means and displaceably secured to said frame, whereby originals can be fed over said exposure platen between said first and second abutment means and wherein a second pair of first and second rollers is positioned adjacent to said second abutment means, and which pair is displaceable together with said second abutment means along said platen, said pressure member being entrained about said second pair whereby said first roller of said pair is adapted to press said pressure member against said platen when first roller of the first pair of rollers is displaced by said displacement means.

3. A device according to claims 1 or 2, wherein each abutment means comprises a bar and a thin strip of resilient material secured against said bar one edge of the strip projecting beyond the bar and adapted to press against said exposure platen in said operative position.

4. A device according to claim 3, wherein said bar is secured to said frame so as to be movable in two directions perpendicular to one another in order to lift said strip from said platen and displace said strip in the lifted position and deposit same on another part of said platen.

5. A device as claimed in claim 3, wherein said strip projects from said bar about 0.5 to 1.0 mm.

6. A device as claimed in claim 4, wherein said strip projects from said bar 0.5 to 1.0 mm.

* * * * *

UNITED STATES PATENT AND TRADEMARK OFFICE

CERTIFICATE OF CORRECTION

PATENT NO. : 4,716,440

DATED : December 29, 1987

INVENTOR(S) : Franciscus A.C.M. Couwenberg, Cornelis J. Groenenberg and Antonius C.S. Wetjens It is certified that error appears in the above-identified patent and that said Letters Patent is hereby corrected as shown below:

Column 2, line 28, delete "left" and substitute therefor -- lift --; and

Column 3, line 29, after "e.g.," delete "015" and substitute therefor -- 0.5 --.

Signed and Sealed this

Twelfth Day of July, 1988

*Attest:*

DONALD J. QUIGG

*Attesting Officer*

*Commissioner of Patents and Trademarks*